United States Patent [19]

Rausing

[11] Patent Number: 4,838,428

[45] Date of Patent: Jun. 13, 1989

[54] OPENING ARRANGEMENT ON PACKING CONTAINERS

[75] Inventor: Hans Rausing, Wadhurst, Great Britain

[73] Assignee: AB PROFOR, Lund, Sweden

[21] Appl. No.: 147,299

[22] Filed: Jan. 22, 1988

[30] Foreign Application Priority Data

Feb. 24, 1987 [GB] United Kingdom ..... 8704289

[51] Int. Cl.[4] ..... B65D 3/26

[52] U.S. Cl. ..... 206/603; 222/531; 220/90.4

[58] Field of Search ..... 222/531, 537, 561; 206/603, 611, 612, 615, 601; 220/90.2, 90.4

[56] References Cited

U.S. PATENT DOCUMENTS

| | | | |
|---|---|---|---|
| 2,921,720 | 1/1960 | Malachick | 222/531 |
| 3,024,950 | 3/1962 | Frison | 222/531 |
| 3,105,620 | 10/1963 | Atkins et al. | 222/561 |
| 3,118,577 | 1/1964 | Estabrook | 222/561 |
| 3,185,357 | 5/1965 | Merkel | 222/561 |
| 3,696,977 | 10/1972 | Davenport et al. | 222/561 |
| 4,197,985 | 4/1980 | Austin | 222/561 |
| 4,589,579 | 5/1986 | Morita | 222/561 |

*Primary Examiner*—Joseph Man-Fu Moy

*Attorney, Agent, or Firm*—Burns, Doane, Swecker & Mathis

[57] ABSTRACT

A readily openable and reclosable opening arrangement for use on a packing container comprises a pouring pipe attached to the outside of the packing container, wherein a slide is maneuverable within the pouring pipe by means of a projecting gripping element. When the slide is pushed to the open position the packing container wall is penetrated by ploughlike elements joined to the slide, so that the contents may be emptied out via the pouring pipe. The opening arrangement also may be used on packing containers which consist of several part containers whose contents may be emptied out through a joint pouring pipe.

15 Claims, 3 Drawing Sheets

OPENING ARRANGEMENT ON PACKING CONTAINERS

FIELD OF THE INVENTION

The present invention relates to an opening arrangement on a packing container, preferably of the type which is intended for non-returnable usage and is manufactured from a flexible, laminated packing material.

BACKGROUND OF THE INVENTION

In the manufacture of such packing containers usually a packing laminate is used which comprises a central carrier layer of fibrous material, covered on both sides by homogeneous layers of thermoplastic material. The packing material is converted with the help of packing machines through folding and sealing to individual packing containers filled with liquid contents (e.g. milk). The packing containers have different types of opening arrangements, which in their simplest form may consist of a printed opening indication and which on more sophisticated packing containers may be constituted of a prepared pouring opening which can be exposed and reclosed with the help of a pull-off cover strip.

Known types of opening arrangements for packing containers of the non-returnable type are subject to various disadvantages, e.g. that they are difficult to open or to reclose, that with certain combinations of contents and type of pouring opening it is difficult to empty out the contents of the package, in a collective, even jet or that they are too complicated and expensive to manufacture. It is a general wish in the packing branch, therefore, to provide an optimum opening arrangement which overcomes the aforementioned problems.

SUMMARY AND OBJECTS OF THE INVENTION

It is an object of the present invention to provide an opening arrangement on packing containers, this opening arrangement preferably being capable of being combined with known types of packing containers, and to overcome the disadvantages which affected previous opening arrangements.

It is a further object of the present invention to provide an opening arrangement which can be opened by a single movement of the hand and which can be reclosed in the effective manner by a movement of the hand in opposite direction.

It is a further object of the present invention to provide an opening arrangement which has good pouring properties in the case of those types of contents which cause difficulties in combination with known types of opening arrangements.

It is a further object of the present invention to provide an opening arrangement which is simple to manufacture and to assemble and which is inexpensive in relation to the total cost of the package.

It is a further object of the present invention to provide an opening arrangement which makes it possible in a rational and cost-effective manner to combine several individual packing containers with one another so that they can be handled and used by the consumer as a single packing container of a large volume.

These and other objects have been achieved through the invention in that an opening arrangement for use on packing containers comprises a pouring pipe joined to the wall of the packing container which in its side facing towards the packing container wall has an opening, and a slide displaceable in the pipe with a tearing component, which in the closed position of the opening arrangement is located in the pipe, and in the open position of the opening arrangement extends out through the opening of the pipe and into the packing container so that the inner space of the latter is in communication with the environment via the pipe.

Preferred embodiments of the opening arrangement in accordance with the invention are evident from the subsidiary claims.

This opening arrangement, which is manufactured separately from thermoplastic material and is assembled thereafter on the packing container, is simple to open and to reclose and has very good pouring properties. Opening arrangements of this type, that is to say opening arrangements with a defined outlet duct, may also be used to combine several conventional packing containers to one another and in this manner create a packing container of a large volume.

A preferred embodiment of the opening arrangement in accordance with the invention will now be described in more detail with reference to the attached schematic drawings which only show the details indispensable for an understanding of the invention.

DETAILED DESCRIPTION OF A PREFERRED EMBODIMENT

Figure 1:
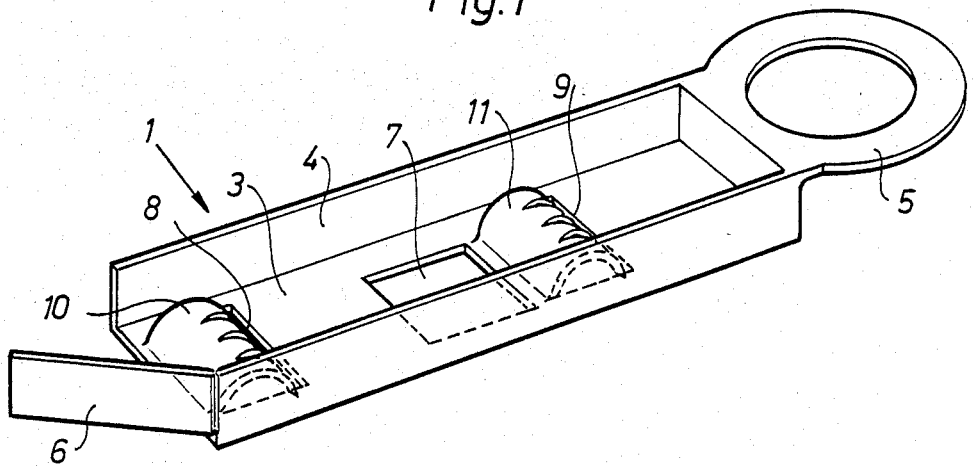
FIG. 1 is a view of a main part of the opening arrangement in accordance with the invention.
Figure 2:
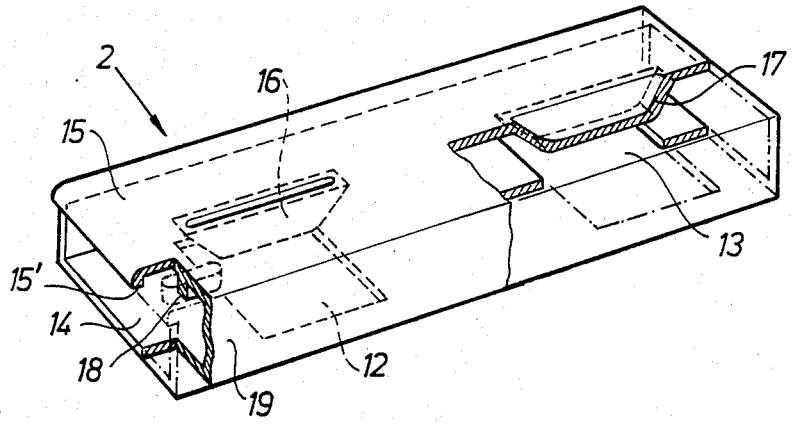
FIG. 2 is a perspective and partially sectional view of another main part of the opening arrangement in accordance with the invention.

The opening arrangement in accordance with the invention comprises two cooperating main parts, namely a first main part in the form of a slide 1 and a second main part in the form of a pouring pipe 2. Both parts are manufactured from a plastic material, e.g. polyethylene, and are designed so that they can be assembled inside each other by pushing the slide 1 in through the one open end of the pouring pipe 2 (the rear end, that is to say the righthand one, in the Figure). The slide 1 is of substantially rectangular shape and comprises a bottom surface 3 with longitudinal edges 4 which extend at a substantially right angle upwards from the bottom surface 3. At one (rear) end of the slide a gripping element 5 is located which in the preferred embodiment described is of substantially circular ring-shape, but which, of course, may be of any other suitable shape, e.g. a shape which indicates to the consumer the correct direction of pulling. At the opposite, front, end of the slide there is a projecting wall part in the form of a flap 6 which is attached to the one edge 4 of the slide by means of a weakened portion serving as a hinge. The flap is of a length which corresponds to the width of the slide and a height which corresponds to the height of the edges 4.

The bottom surface 3 is provided with a substantially centrally placed, rectangular opening 7 and two openings 8,9 located on either side. In each of the latter two there is a tearing component 10,11 which is formed in one piece with the slide and is connected to the bottom surface of the same at one edge of the respective opening 8,9, more particularly the remote edge in relation to the gripping element 5. The two tearing components 10 are substantially arc-shaped and oriented so that the highest point of their arched or convex surface is at a level with, or slightly below, the upper limiting line of the two edges 4, while the free ends of the tearing components 10 facing towards the gripping element 5, are substantially in a plane with the bottom surface 3. The ends of the tearing components 10,11 facing towards the gripping element 5 have a number of projecting, pointed portions which are designed as relatively sharp "edges" or "ploughs".

The second main part of the opening arrangement, or the pouring pipe 2, is of a length which by and large coincides with the length of the bottom surface 3 and is of square cross-section, the width and height of which substantially correspond to, or slightly exceed, the width and height respectively of the bottom surface 3 and the edges 4 of the slide 1. It is thus possible to push the slide 1 into the pipe 2 in such a manner that the slide can be pushed to and fro in the pipe with small resistance by means of the gripping element 5.

The bottom surface 14 of the pouring pipe 2 is provided with two openings 12,13 which are located at some distance from each other and have between them an unbroken portion of the bottom surface 14. Above the two openings 12,13 the upper wall surface 15 of the pipe is provided with two projections or ridges 16,17 extending in the longitudinal direction of the pipe which are formed by pressing down the upper wall surface 15 to the desired depth. The height of the ridges 16,17 corresponds substantially to half the distance between the bottom surface 14 of the pipe and its upper wall surface 15, and the length of the ridges corresponds substantially to the corresponding longitudinal dimension of the openings 12,13. The ridges 16,17 serve as an opening means for engaging the tearing components 10,11 and displacing them through the openings 12,13 in the pipe 2.

Figure 3:
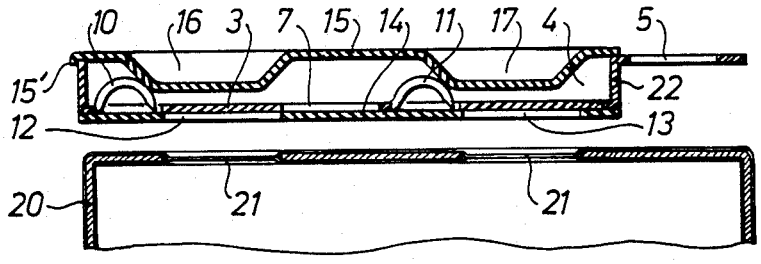
FIG. 3 is a sectional view of the main parts of the opening arrangement shown in FIG. 1 and FIG. 2 after assembly, but before application to a packing container, whose top part is also shown as a sectional view.
Figure 4:
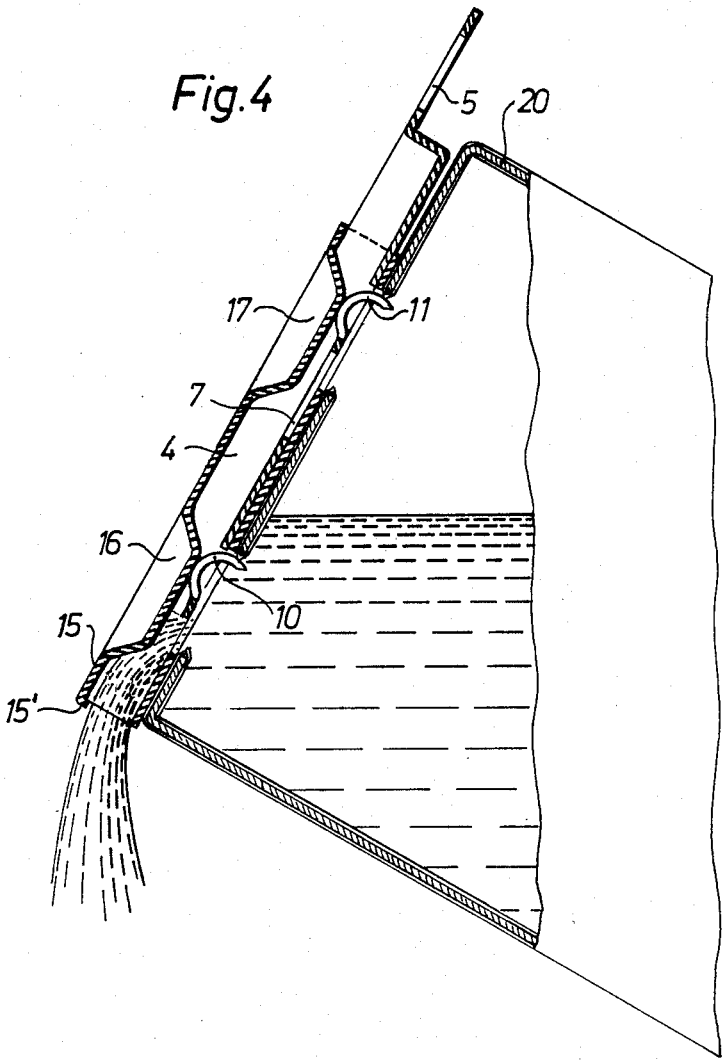
FIG. 4 is a sectional view through the opening arrangement in accordance with the invention in an opened position during pouring out of the contents from a packing container.

When the two main parts 1,2 of the opening arrangement have been assembled by virtue of the slide 1 having been pushed into the pouring pipe 2 so that only the gripping element 5 projects from the one end of the pouring opening, the opening arrangement is ready to be assembled on a prefabricated packing container filled with liquid contents (FIG. 3). The packing container is of substantially known design and is produced by folding, forming and sealing a flexible packing laminate which, for example, may comprise a central carrier layer of fibrous material which is coated on both sides with thin layers of thermoplastic material, e.g. polyethylene, and possibly also further layers of barrier type material, e.g. aluminium foil. The material of the packing container 20 may possibly be provided on the top side of the packing container, or at the point where the opening arrangement, in accordance with the invention, is intended to be attached, with weakened areas 21 in which the stiffening fibrous material has been excluded so that only comparatively thin layers of thermoplastic material and possibly aluminium foil remain. The two weakened areas 21 are designed and located so that after application of the opening arrangement, they largely coincide with the extent and the location of the two openings 12,13 provided in the bottom surface 14 of the pouring pipe. On application of the opening arrangement, in accordance with the invention, to a previously manufactured plane top surface of a packing container known in itself, the opening arrangement is positioned as shown in FIG. 3 and is joined to the top wall surface with the help of an adhesive applied to the bottom surface of the pouring pipe, which prior to application has been activated e.g. through the supply of heat. After the application, the front end of the opening arrangement, that is to say the end provided with the flap 6, will extend slightly (1–5 mm) outside an adjacent edge of the top surface of the packing container while the gripping element 5, preferably, should not extend outside the opposite edge surface of the packing container. With such a placement, it will be possible simply to pour out the contents without any risk of the contents running along the outside of the packing container. Also, since the opening arrangement does not extend too far beyond the contours of the top surface of the packing container, the opening arrangement is optimally protected during handling of the packing container, so that damage or unintentional opening are prevented.

When the opening arrangement in accordance with the invention has been assembled on a packing container and is to be used by the consumer for pouring out the liquid contents of the packing container, the consumer holds the projecting gripping element 5 and pulls the same backwards until the slide 1 has been partly pulled out of the pouring pipe 2. In so doing, the upper surfaces of the two tearing components 10,11 come into contact with the two ridges 16,17 extending downwards from the upper wall surface 15 of the pipe. On continued displacement of the slide 1 in the direction of the gripping element 5, the tearing components 10,11 will be forced underneath the two ridges 16,17 until the space between the lower surface of the ridges and the bottom surface 14 of the pouring pipe becomes too small to accommodate the curved tearing components 10,11 room. As a result, the front, sharp-pointed edges will be forced down through the two openings 12,13 in the bottom surface 14 of the pouring pipe and, in a ploughlike manner, further through the two weakened areas 21 in the upper wall surface of the packing container. As soon as the edgebearing front ends of the tearing components 10,11 have been forced through plastic and aluminium layers present in the weakened areas 21, the tearing components 10,11 will continue to swivel downwards, with the weakened connecting surface between the respective tearing components 10,11 and the bottom surface 3 of the slide serving as a hinge. A continued pull-out of the slide 1 with the help of the gripping element 5 is prevented when the tearing components 10,11 reach the rear edge of the openings 12,13 in the bottom surface 14 of the pipe, in which position the tearing components 10,11 have penetrated and practically completely pushed aside the layers in the weakened areas 21 of the packing container, so that the interior of the packing container, via the openings produced, and the pouring pipe 2 are in communication with the environment. In connection with the pull-out of the slide 1, a wall part 22 located at the transition between the gripping element 5 and the bottom surface 3 has been removed from the open rear end of the pouring pipe 2, so that the surrounding air communicates with the interior of the packing container. In a corresponding manner, the flap 6 located at the opposite end of the slide 1, through the effect of the lip 18, has been forced to the side, so that the pouring opening of the pouring pipe has been opened and the contents can be poured out. The volume emptied out from the packing container is compensated through intake of surrounding air via the rear opening of the opening arrangement.

When the consumer, after pouring out of the desired quantity of contents, wishes to reclose the packing container, the slide 1 is returned with the help of the gripping element 5 to its original position inside the pouring pipe 2. In so doing, the two tearing components 10,11, owing to contact with the front edges of the openings 12,13 will be swivelled up again, out of the openings so that the slide 1 can revert to its original position, whereby the unbroken parts of the bottom surface 3 of the slide will cover the broken portions of the packing container wall, so that the two openings 12,13 are completely covered and the communication between the interior of the packing container and the environment is completely cut off. On the return of the slide 1 to its original position, the free end of the flap 6 will come into contact with the folded-down front edge 15' of the pouring pipe 15, so that the flap is brought at a right angle against the edge 4 and thereby completely covers the pouring opening of the pipe 2 so that extraneous objects such as dirt or the like are prevented from penetrating from the outside into the pipe.

On renewed opening of the packing container, the two tearing components 10,11 of the slide will, of course, penetrate down into the packing container through the openings and the opening arrangement in accordance with the invention can be opened and closed without a problem any number of times.

Figure 5:
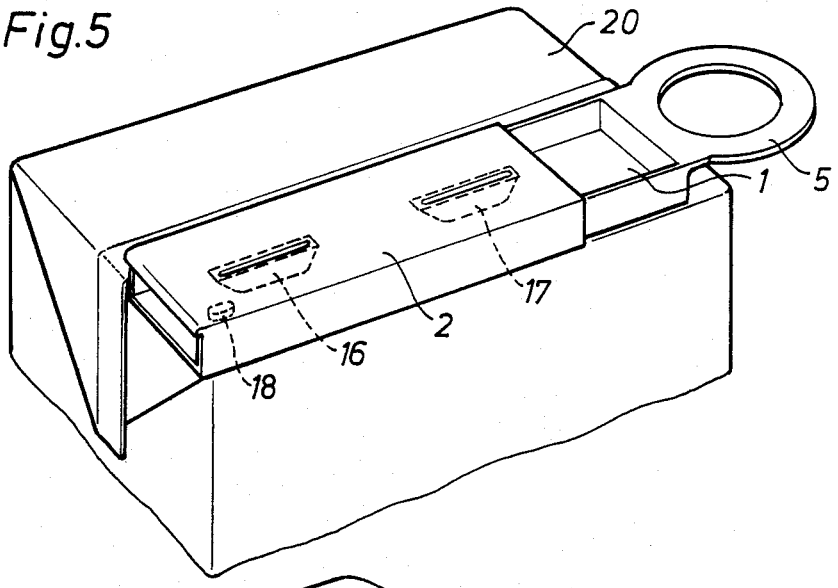
FIG. 5 is a perspective view of the opening arrangement in accordance with the invention assembled on a packing container.
Figure 6:
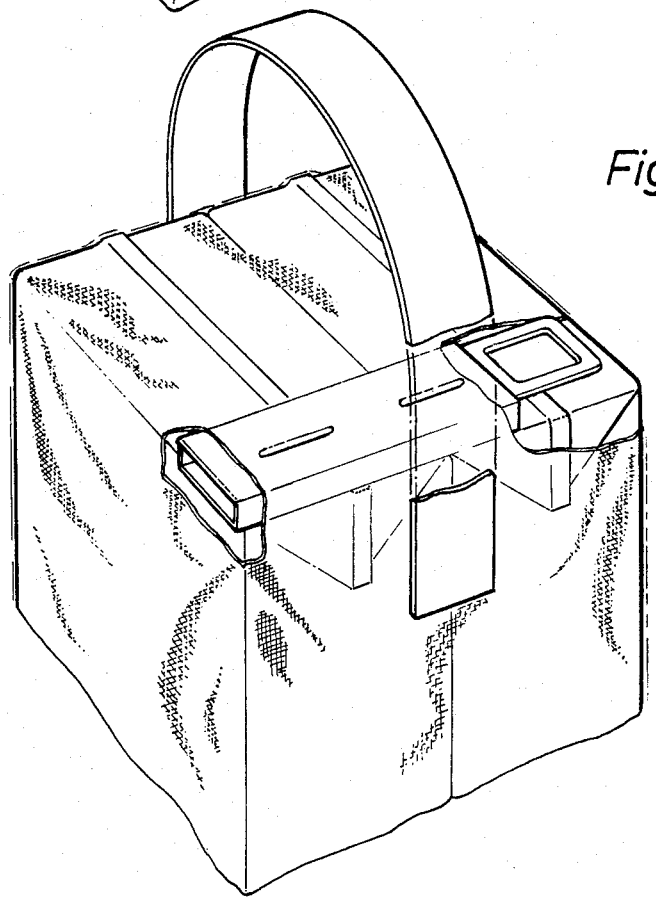
FIG. 6 shows an embodiment of the opening arrangement in accordance with the invention assembled on another type of packing container which comprises two part containers.

The preferred placing of the opening arrangement in accordance with the invention on a packing container of well-known parallelepiped type is shown in FIG. 5, where the opening arrangement is in its opened position. The opening arrangement can be used of course on any suitable type of packing container whatever, and in FIG. 6 is shown an embodiment where the opening arrangement is used so as to make possible the opening of, and the pouring out of contents from, a double package which consists of two individual packing containers (part containers) of known type placed tightly adjoining each other and connected to each other. The opening arrangement, which is of the type described above or, in any case, is of the type which comprises a pouring pipe or an outlet duct, extends over the top sides of both part containers and connects openings on the two part containers with one another, the pouring pipe acting as a joint outlet duct. The slide of the opening arrangement here is provided with a suitable number of tearing components (with corresponding openings in the pouring pipe), e.g. four. The embodiment described earlier with two tearing components for each packing container assumes that a special air opening is necessary, but this is by no means always the case, and it is only a requirement, therefore, that one opening with associated tearing component should be present on each one of the two packing containers connected to each other. The two part containers forming the double packing container are both opened when the consumer maneuvers the opening arrangement, and on emptying out the contents of the package, the same flows through the same pouring pipe from both part containers. The part containers preferably are wrapped by a common plastic film which is shrunk round the packing containers as well as the opening arrangement and has holes for both ends of the opening arrangement. The plastic film here serves on the one hand as a stabilizing wrapping and on the other hand as a decorative film for the two unprinted part containers. As seen in FIG. 6, the arrangement can be also provided with a handle, e.g. a strap, extending at a distance over the top of the packing containers. The opening arrangement in accordance with the invention permits the manufacture of packing containers having, for example, double volume, by combining several packing containers in a unit. Thus, the opening arrangement of the present invention permits larger package volumes to be rapidly manufactured in a simple manner and with relatively small costs.

While this invention has been illustrated and described in accordance with a preferred embodiment, it is recognized that variations and changes may be made and equivalents employed herein without departing from the invention as set forth in the claims.

What is claimed is:

1. In packing containers for pourable contents, an opening arrangement comprising:

a pouring pipe joined to a wall of a packing container, said pouring pipe having a side facing toward the packing container, said side having an opening therein;

a slide displaceable relative to said pipe so as to define a closed position and an open position of the opening arrangement, said slide having a tearing component which is movable from a raised position to a lowered position extending through said pipe opening, and opening means on said pipe for engaging said tearing component to displace said tearing component through said pipe opening upon displacement of said slide relative to said pipe, thereby allowing the contents of the container to be poured through said opening and through said pipe.

2. An opening arrangement in accordance with claim 1, wherein said opening means includes a ridge located in said pipe opposite the opening, said ridge engaging the tearing component to displace the tearing component through the opening of the pipe when the slide is moved to the open position.

3. An opening arrangement in accordance with claim 1, wherein the tearing component has a pointed edge in position to pierce the wall of the container when the slide is displaced from the closed position to the open position.

4. An opening arrangement in accordance with claim 1, wherein said slide has a plurality of tearing components attached thereto and wherein said pipe has a plurality of associated openings.

5. An opening arrangement in accordance with claim 1, wherein said pipe has a rectangular cross-section.

6. An opening arrangement in accordance with claim 1, wherein the pipe is attached to the outside of the packing container by means of glue.

7. An opening arrangement in accordance with claim 1, wherein the pipe has two open ends which are covered by wall parts projecting from the slide when the opening arrangement is in the closed position.

8. An opening arrangement in accordance with claim 1, wherein one end of the slide is provided with a gripping element which projects outwardly from a rear end of said pipe.

9. An opening arrangement in accordance with claim 1, wherein said pipe is secured to a plurality of individual packing containers.

10. An opening arrangement in accordance with claim 9, wherein the individual containers are wrapped in a common plastic film which is shrunk onto the individual containers and the opening arrangement, the plastic film having holes for access to end portions of the opening arrangement.

11. An opening arrangement for use on packing containers comprising:

a pouring pipe having an opening therein;

a slide displaceable relative to the pouring pipe so as to define open and closed positions, said slide having a tearing component on a bottom side of said slide, said tearing component being movable from a raised position to a lowered position extending through the opening in the pouring pipe, and opening means on said pipe for engaging said tearing component to displace said tearing component from said raised position to said lowered position upon displacement of said slide relative to said pipe.

12. An opening arrangement in accordance with claim 11, wherein two tearing components are hingedly mounted to the bottom side of said slide and wherein said pouring pipe has two openings therein.

13. An opening arrangement in accordance with claim 11, wherein said pouring pipe has two openings therein and wherein said opening means comprises two ridges which extend into an interior of the pouring pipe, each ridge being located opposite one of said openings.

14. An opening arrangement in accordance with claim 13, wherein two tearing components are hingedly mounted to the bottom side of the slide, said tearing components comprising arc-shaped members having a height such that when the opening arrangement is in the open position, said arc-shaped members contact said ridges so as to displace the arc-shaped member from said raised position to said lowered position.

15. An opening arrangement in accordance with claim 11, wherein said tearing component comprises a hingedly mounted, arc-shaped member and wherein said opening means comprises a ridge attached to a side of said pouring pipe which is located opposite to the side having said opening therein and extending toward an interior of the pouring pipe, said ridge serving to force the tearing component through the opening in said pouring pipe when the opening arrangement is in the open position.

* * * * *